US007380955B2

(12) United States Patent
Lu et al.

(10) Patent No.: US 7,380,955 B2
(45) Date of Patent: Jun. 3, 2008

(54) FAN ASSEMBLY

(75) Inventors: Lobato Lu, Taoyuan Hsien (TW); Ke-Nan Wang, Taoyuan Hsien (TW); Wen-Shi Huang, Taoyuan Hsien (TW)

(73) Assignee: Delta Electronics, Inc., Taoyuan Hsien (TW)

( * ) Notice: Subject to any disclaimer, the term of this patent is extended or adjusted under 35 U.S.C. 154(b) by 224 days.

(21) Appl. No.: 10/994,309

(22) Filed: Nov. 23, 2004

(65) Prior Publication Data

US 2006/0002103 A1 Jan. 5, 2006

(30) Foreign Application Priority Data

Jun. 30, 2004 (TW) ..... 93119412 A

(51) Int. Cl.
*F21V 33/00* (2006.01)

(52) U.S. Cl. ..... 362/96; 362/373

(58) Field of Classification Search ..... 362/96, 362/294, 362, 373; 416/5; 417/423.14
See application file for complete search history.

(56) References Cited

U.S. PATENT DOCUMENTS 6,832,895 B2 * 12/2004 Yoshioka et al. ..... 416/5
2005/0237491 A1 * 10/2005 Lin et al. ..... 416/5

* cited by examiner

*Primary Examiner*—Y. My Quach-Lee
(74) *Attorney, Agent, or Firm*—Birch, Stewart, Kolasch & Birch, LLP

(57) ABSTRACT

A fan assembly. The fan assembly is applicable to a light source that produces heat. The fan assembly comprises a frame and an impeller. The frame comprises an opening, and a periphery of the opening has a curved surface. The impeller is disposed in the frame. When light emitted from the light source enters the opening, the light is blocked from penetrating the opening by the curved surface.

21 Claims, 7 Drawing Sheets

FAN ASSEMBLY

BACKGROUND

The invention relates to a fan assembly, and in particular to a fan assembly applicable to a light source producing heat.

With the continuous development of electronic devices, heat dissipation systems become necessary as temperature is significantly increased due to heat produced during operation. If heat is not appropriately dissipated, high temperature causes performance to deteriorate and may cause the electronic devices to fail. Particularly, since semiconductor and integrated circuits (IC) design has improved, the integrated circuit size has been reduced and the number of transistors per unit area has substantially increased, further concentrating heat energy. Thus, a heat dissipation system is required to effectively dissipate the excess heat and maintain working temperature.

Fan assembly is the most popular heat dissipation apparatus. FIG. 1A is a top view of a conventional fan assembly, and FIG. 1B is a cross section of FIG. 1A. As shown in FIGS. 1A and 1B, the conventional fan 10 comprises a frame 11, an impeller 15, and a motor (not shown). The motor is disposed in a motor base 12 to drive the impeller 15. The frame 11 comprises a body with an opening defined therein. The motor base 12 disposed in the frame 11 is supported by a plurality of ribs 13. The ribs 13 can be cylindrical, arced, or streamlined. The impeller 15 comprises a plurality of radially arranged blades 14.

In FIG. 1B, as known, when two ribs 13 are both connected to the motor base 12 and the frame 11, they are not located along the same diameter of the impeller 15, and the cross section of the two ribs 13 would be discontinuous. For clear illustration, however, the ribs are shown in their entirety in FIG. 1B.

During rotation of the impeller 15, a gap is formed between the frame 11 and the blades 14 to prevent contact therebetween, which produces friction and noise, as shown in FIG. 1A. If the fan assembly 10, however, is applied to an optical machine to dissipate heat of the light source (lamp) L, the emitted light $L_p$ may partially penetrate the gap between the frame 11 and the blades 14, causing light loss, as shown in FIG. 1B. Consequently, projected light intensity is reduced, and if escaped light $L_p$ continuously illuminates other areas or objects such as a desk, the surface of the desk can be damaged by the light. The escaped light not only damages the surroundings but also causes safety concerns.

SUMMARY

Embodiments of the invention provide a fan assembly with various frames and corresponding blade edge designs to fully obstruct a light path between the blades and the frame, for preventing loss of light.

Embodiments of the invention further provide a fan assembly applicable to a light source that produces heat. The fan assembly comprises a frame and an impeller. The frame comprises an opening and a periphery of the opening has a curved surface. The impeller is disposed in the body. When light emitted by the light source enters the opening, the light is blocked from penetrating the opening by the curved surface. Moreover, the opening of the body comprises an inlet and an outlet, the emitted light entering the inlet is blocked by the curved surface, preventing light emission from out of the outlet.

Embodiments of the invention further provide a fan assembly applicable to a light source that produces heat. The fan assembly comprises a frame and an impeller. The frame comprises an opening and a periphery of the opening has at least one inclined surface. The impeller is disposed in the body. When light emitted by the light source enters the opening of the frame, the light is blocked from penetrating the opening by the inclined surface. The periphery of the opening comprises multi-sectional inclined surfaces with different inclined angles. The impeller comprises blade edges, parallel to the multi-sectional inclined surfaces. Moreover, the periphery of the opening comprises multi-sectional inclined surfaces, protruded toward a central axis of the opening, and the impeller comprises blade edges facing the concave sides of the multi-sectional inclined surfaces, and the periphery of the opening exceeds a line connected by two ends of the concave sides.

Further scope of the applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present application will become more fully understood from the subsequent detailed description and the accompanying drawings, which axe given by way of illustration only, and thus are not limitative of the present invention, and wherein.

DETAILED DESCRIPTION

First Embodiment

Figure 1A:
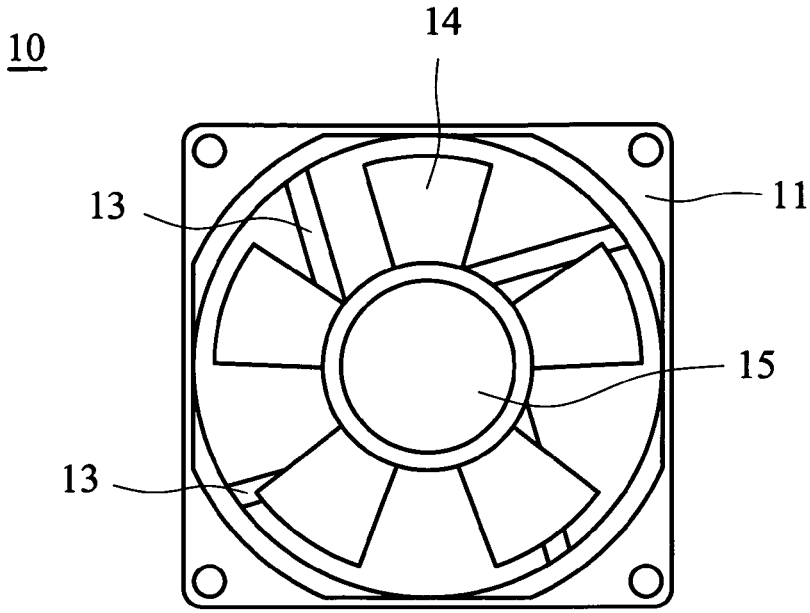
FIG. 1A ( RELATED ART )
FIG. 1A is a top view of a conventional fan assembly.
Figure 1B:
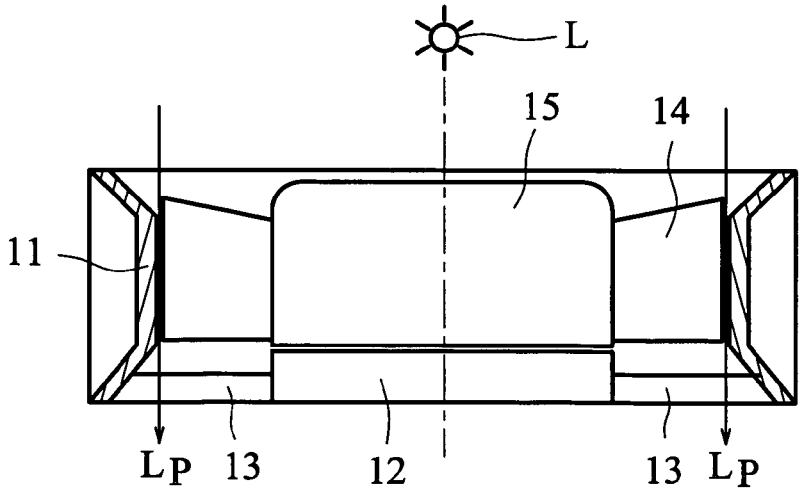
FIG. 1B ( RELATED ART )
FIG. 1B is a cross section of the conventional fan assembly.
Figure 2A:
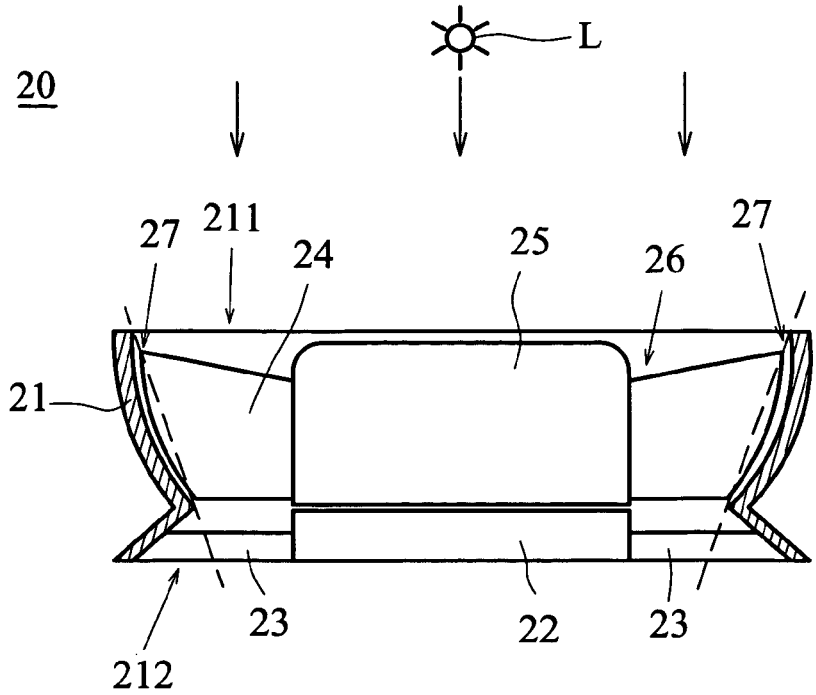
FIGS. 2A and 2B are cross sections of two fan assemblies according to a first embodiment of the invention.
Figure 2B:
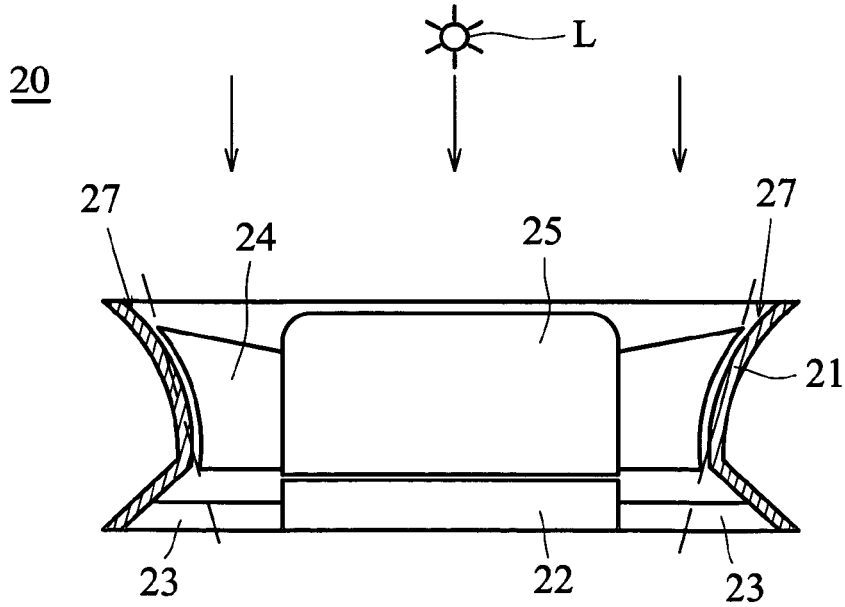

FIGS. 2A and 2B are cross sections of a fan assembly according to a first embodiment of the invention. The fan assembly 20 comprises a frame 21, an impeller 25, and a motor (not shown). The motor is disposed in a motor base 22 for driving the impeller 25. The frame 21 comprises a body with an opening 26 defined therein. The periphery 27 of the opening 26 has a curved surface. The motor base 22 is disposed in the body of the frame 21 and supported by a plurality of ribs 23. The impeller 25 comprises a plurality of radially arranged blades 24.

When the fan assembly 20 for dissipating heat is applied to a light source L producing heat such as a light bulb of a projector, light emitted by the light source L enters the opening 26, and the periphery 27 of the opening 26 has a curved surface for blocking the light, and thus, the light is prevented from penetrating the opening 26.

The periphery 27 of the opening 26 can have a curved surface depressed toward a central axis of the opening 26, as shown in FIG. 2A. The curved surface of the periphery 27 gradually contracts, and the blade edges of the impeller 25 correspond to the curved surface of the periphery 27 of the opening. Each edge of the blade 24 exceeds an imaginary line connected by two ends of the curved surface of the periphery 27. The imaginary line is represented by a dashed line in FIG. 2A. The blade edges of the impeller 25 are preferably parallel to the curved surface.

An inlet 211 and an outlet 212 are respectively formed at two ends of the opening 26 on the frame 21. The light emitted by the light source L enters the inlet 211 into the frame 21. The periphery 27 of the opening 26 having a concave surface corresponding to the blade edges can prevent light leakage from the outlet 212. Since a possible light path can be completely blocked at the location between the blades 24 and the frame 21, the problem of loss of light in a projector utilizing a conventional fan can be prevented. Furthermore, according to differing curved surfaces of the periphery 27 of the opening 26, area of the external edge of the blades 24 can be further increased, thereby increasing air pressure.

Alternatively, the periphery 27 of the opening 26 can have a convex surface protruded toward a central axis of the opening 26, as shown in FIG. 2B. The frame 21 has an inwardly concave side, and the blade edges of the impeller 25 correspond to the convex surface of the periphery 27 of the opening 26 to form concave sides separately. The concave side edge of each blade 24 is facing and corresponding to the curved surface of the periphery 27. The blade edges of the impeller 25 are preferably parallel to the convex surface. The protruded convex surface of the periphery 27 of the opening 26 exceeds an imaginary line connected by two ends of the concave side of the blade 24 edges. The imaginary line is represented by a dashed line in FIG. 2B. Thus, when the light is emitted by the light source L, the light can be blocked from penetrating the frame 21, since the protruded surface of the periphery 27 of the opening 26 corresponds to the blade edges.

Furthermore, at the inlet 211 and the outlet 212 of the fan assembly 20 in both FIGS. 2A and 2B, the periphery 27 of the opening 26 or a vicinity thereof can be formed with an inclined angle or a guided inclined angle to increase the cross-sectional area of the flow path and increase air flow intake. Moreover, the curved surface preferably comprises a contracting and an expanding curved surface, or a plurality of radial contracting and expanding curved surfaces in the fan assembly 20 in FIG. 2A or in FIG. 2B. Also, any two adjacent curved surfaces can have different curvature.

Second Embodiment

Figure 3A:
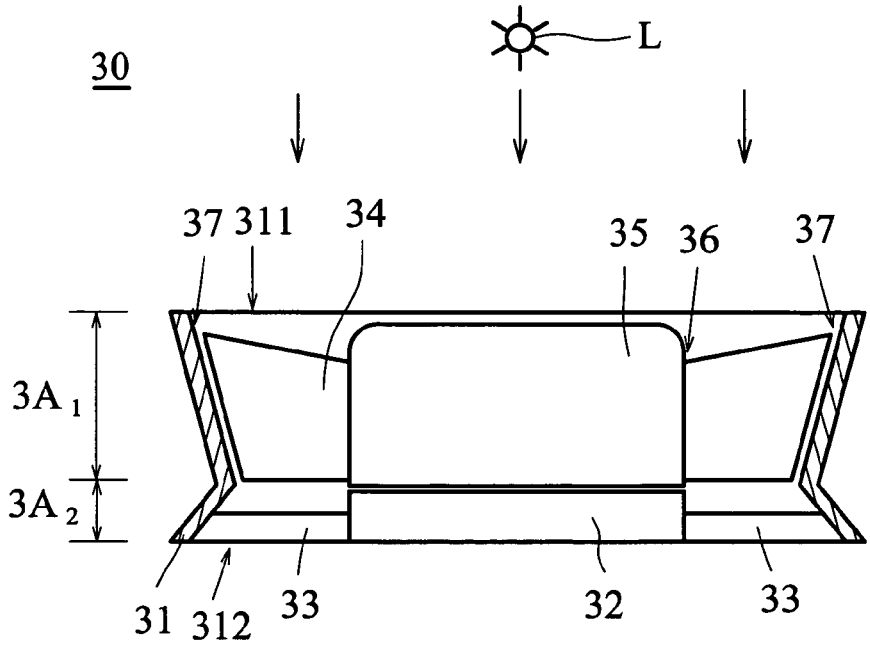
FIGS. 3A and 3B are cross sections of two fan assemblies according to a second embodiment of the invention.
Figure 3B:
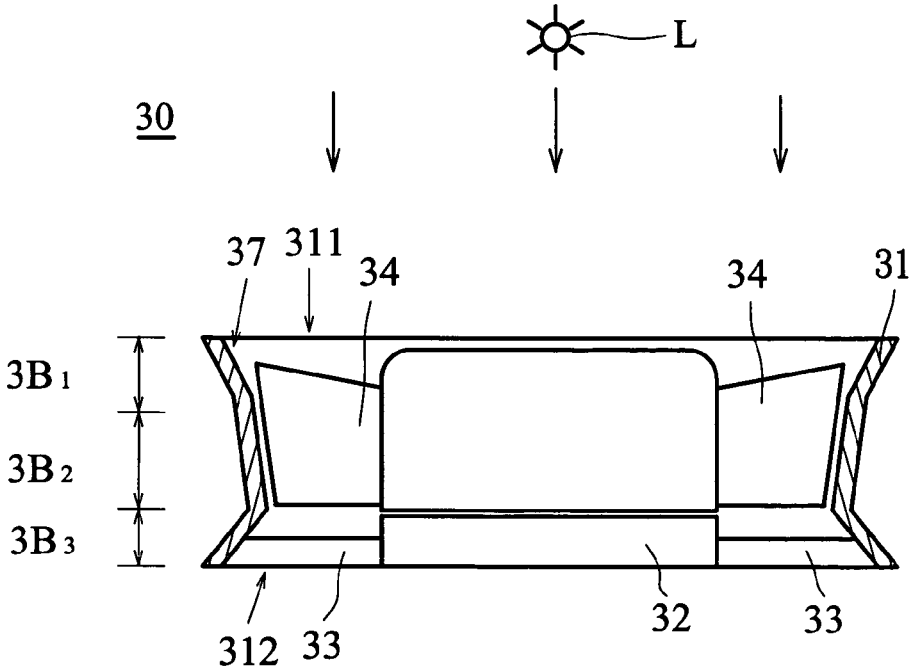

FIGS. 3A and 3B are cross sections of a fan assembly according to a second embodiment of the invention. The fan assembly 30 comprises a frame 31, an impeller 35, and a motor (not shown). The motor is disposed in a motor base 32 for driving the impeller 35. The frame 31 comprises a body with an opening 36 defined thereon. The periphery of the opening 36 has at least one inclined surface. The motor base 32 is disposed in the body of the frame 31 and supported by a plurality of ribs 33. The impeller 35 comprises a plurality of radially arranged blades 34.

When the fan assembly 30 for dissipating heat is applied to a light source L producing heat such as a light bulb of a projector, light emitted by the light source L enters the opening 36, and the periphery 37 of the opening 36 has an inclined surface for blocking the light, and thus, the light is prevented from penetrating the opening 36.

The periphery 37 of the opening 36 comprises multi-sectional inclined surfaces with different inclined angles. For example, an inclined surface comprises a radially contracting inclined surface $3A_1$ and a radially expanding inclined surface $3A_2$, as shown in FIG. 3A. The cross section of the frame 31 is preferably constituted of the contracting inclined surface $3A_1$ and the expanding inclined surface $3A_2$ from the inlet 311 to the outlet 312. An external edge of the blade 34 is parallel to the contracting inclined surface $3A_1$ such that light is effectively blocked from penetrating the frame 31. Also, the expanding inclined surface $3A_2$ increases area of flow path, and increase airflow intake.

Additionally, the inclined surface comprises a plurality of a combination of radially contracting inclined surfaces and radially expanding inclined surfaces, and each two adjacent inclined surfaces are connected at different angles. For example, as shown in FIG. 3B, the crass section of the frame 31 can be considered as being consisted of several inclined surfaces with different angles, such as two contracting inclined surfaces 3B1, 3B2, and one expanding inclined surface 3B3, from the inlet 311 to the outlet 312. The contracting inclined surfaces 3B1, 3B2 can obstruct a potential light path between the blades 34 and the frame 31, and the external edges of the blades 34 arc parallel to the contracting inclined surfaces 3B2. Also, the expanding inclined surfaces 3B3 increase area of the flow path, thereby increasing airflow intake.

Figure 3C:
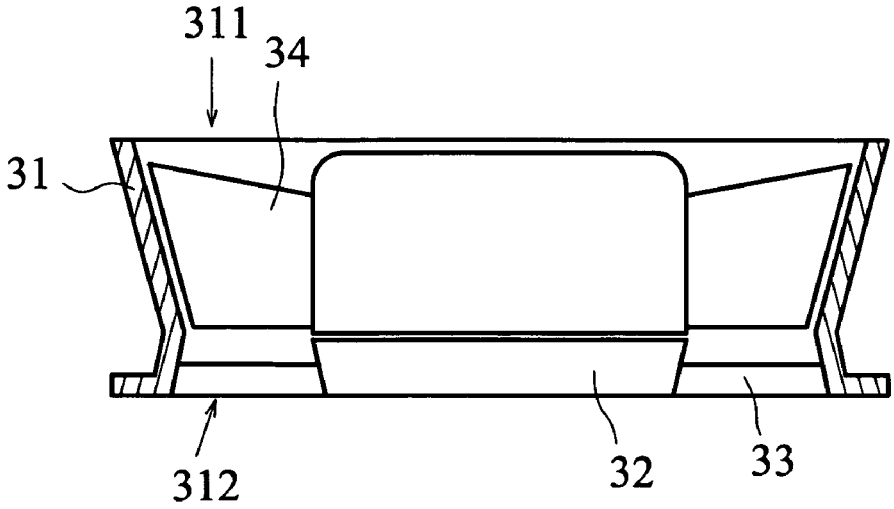
FIGS. 3C and 3D are two cross sections of another fan assemblies according to the second embodiment of the invention.
Figure 3D:
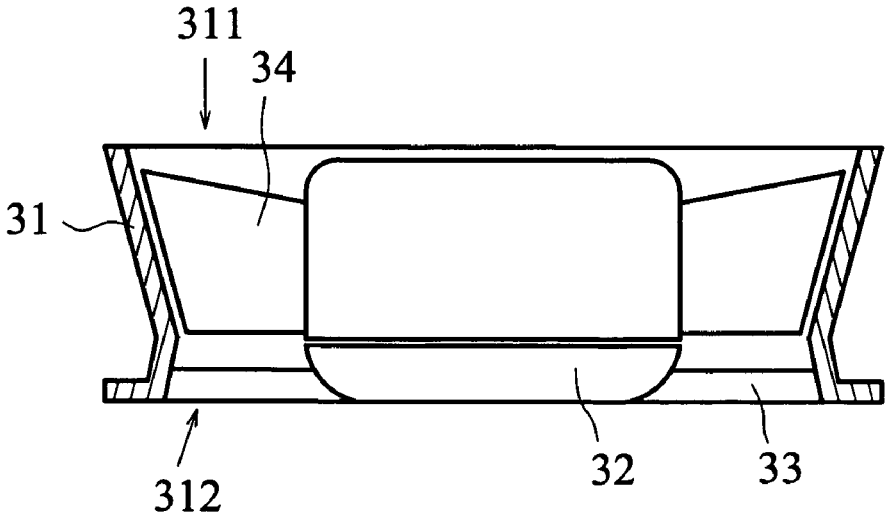

Furthermore, as shown in FIGS. 3C and 3D, the motor base 32 is disposed in the frame 31 and supported by a plurality of ribs 33. The motor base 32 and the ribs 33 can be disposed at the inlet 311 or the outlet 312. In FIGS. 3C and 3D, the motor base 32 comprises a slope inclined radially in order to increase air outflow area, when the motor base 32 and the ribs 33 are disposed at the outlet 312. The slope can have a flat surface (FIG. 3C) or a curved surface (FIG. 3D). If the motor base 32 and the ribs 33 are disposed at the inlet 31 of the frame 31, the inclined motor base 32 can increase inflow area.

Furthermore, the inclined angle of the motor base 32 can be varied in accordance with different curvature of the cross section of the frame 31 to allow air smoothly flow between the motor base 32 and the frame 31, when the blades 34 rotate, so that noise can be reduced.

Third Embodiment

FIGS. 4A to 4F are cross sections of a fan assembly according to a third embodiment of the invention. The fan 40 comprises a frame 41, an impeller 45, and a motor (not shown). The motor is disposed in a motor base 42 for driving the impeller 45. The frame 41 comprises a body with an opening 46 defined thereon. The periphery 47 of the opening 46 comprises at least one inclined surface. The motor base 42 is disposed in the frame 41 and supported by a plurality of ribs 43. The impeller 45 comprises a plurality of radially arranged blades 44.

When the fan assembly 40 for dissipating heat is applied to a light source producing heat such as a light bulb of a projector, light emitted by the light source enters the opening 46, and the periphery 47 of the opening 46 has an inclined surface for blocking the light. The blades 44 have a maximum outer diameter greater than the inner diameter of the periphery 47 of the opening 46. As a result, a potential light path between the blades 44 and the frame 41 can be obstructed by an overlapping portion between the blades 44 and the periphery 47 of the opening 46. Thus, the light is prevented from penetrating the opening 46.

Figure 4A:
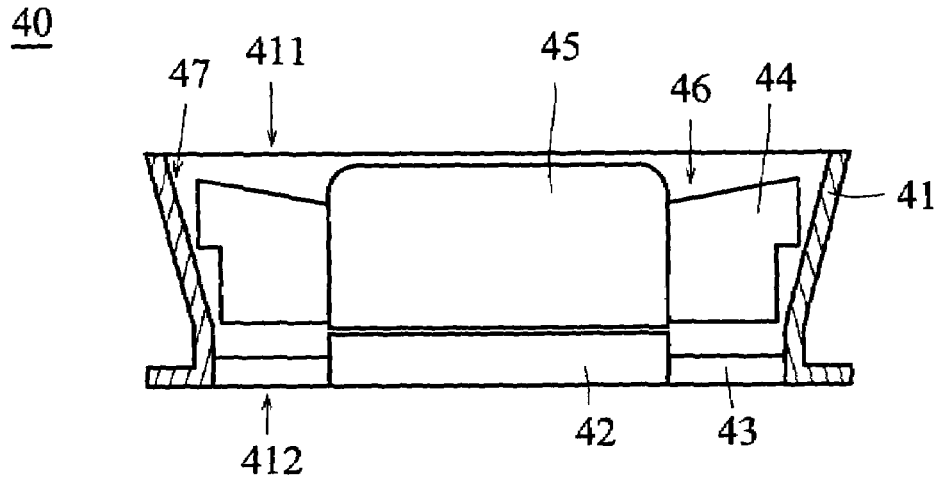
FIGS. 4A to 4F are cross sections of fan assemblies according to a third embodiment of the invention.
Figure 4B:
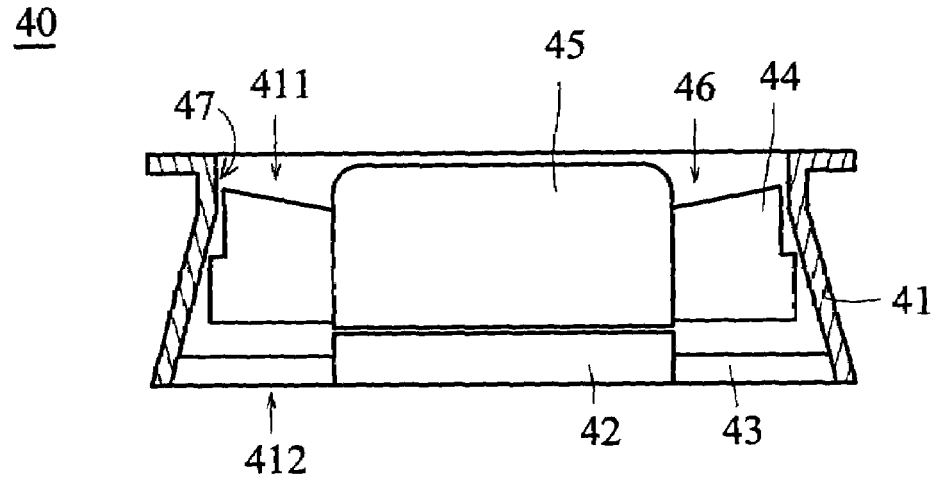
Figure 4C:
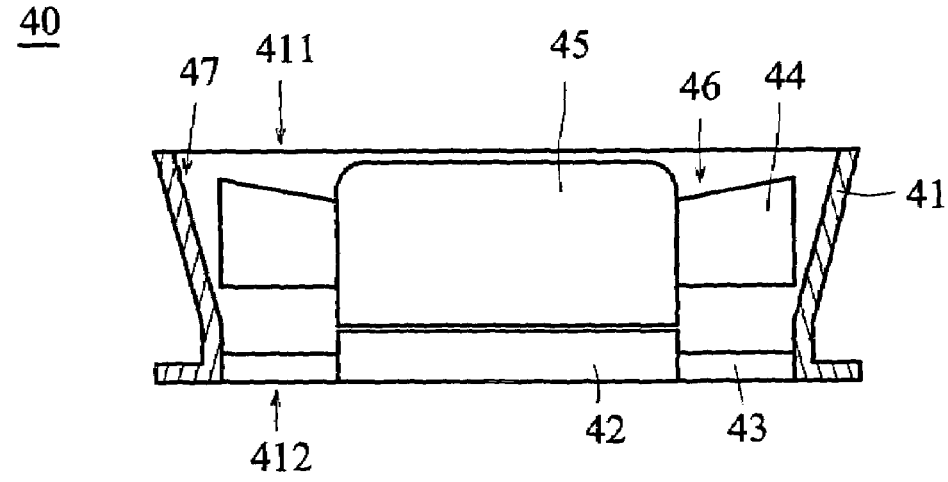
Figure 4D:
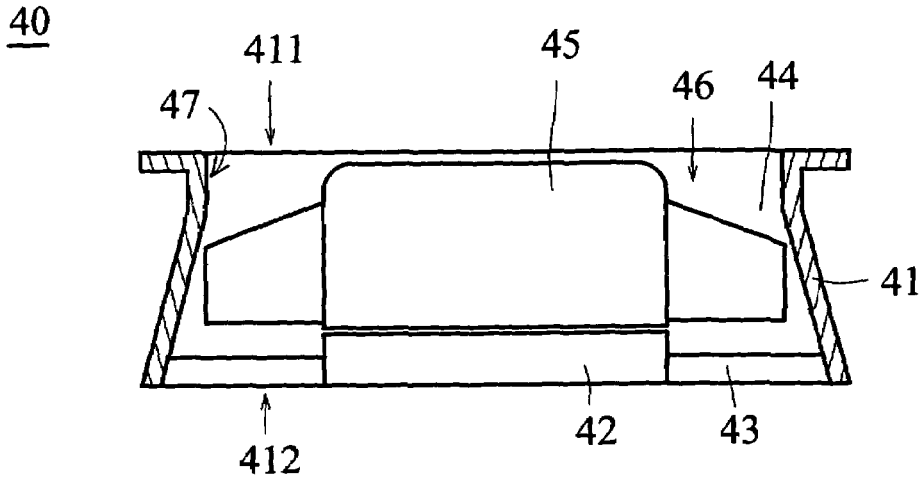
Figure 4E:
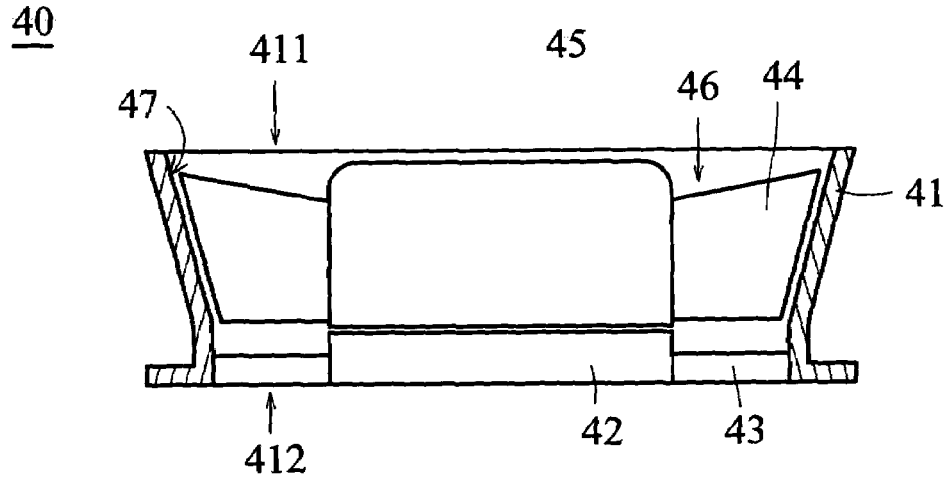
Figure 4F:
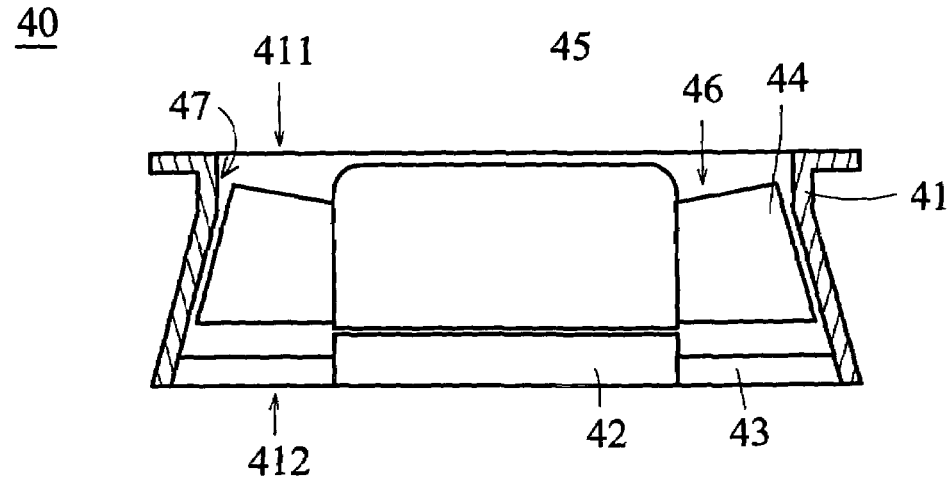

The frame 41 comprises at least one inclined surface or curved surface from an inlet 411 to an outlet 412. The cross section of the frame 41 can be gradually contracting curved surface, expanding curved surface or a combination thereof. The contracting curved surface obstructs the light path between the blades 44 and the frame 41. The expanding curved surface can increase area of the flow path and increase the airflow intake. Furthermore, the external edges of the blades can be designed with various shapes in accordance with the frame 41. For example, the external edges of the blades can be flat (as shown in FIGS. 4C and 4D), conical (as shown in FIGS. 4E and 4F), stepped shapes (as shown in FIGS. 4A and 4B), and so on.

Figure 4G:
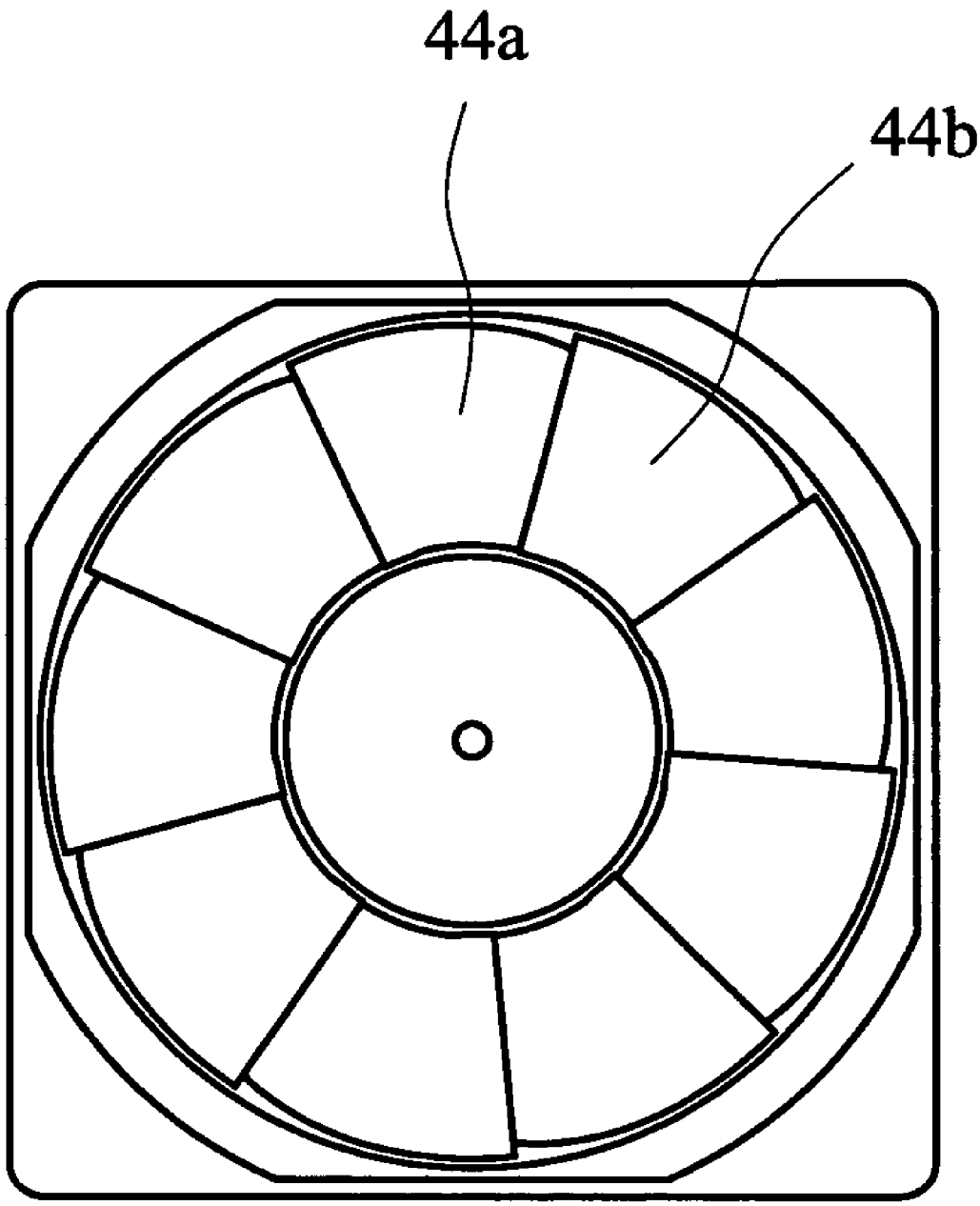
FIG. 4G is a top view of the entire fan assembly according to the third embodiment of the invention.

The invention is not limited to the above embodiments. Moreover, the blades 44 not only have maximum outer diameter greater than a minimum inner diameter of the periphery 47 of the opening 46, each blade 44*a* also partially overlaps with an adjacent blade 44*b* in an axial direction of the opening 46, as shown in FIG. 4G. FIG. 4G is a top view of the entire fan assembly according to the third embodiment of the invention. The overlapping blades can further effectively block the light.

Embodiments of the invention are compared to a conventional fan with a light-blocking experiment with the same size of frame from 50 mm, 60 mm, and 70 mm frames in a black box. A 3000 Lux. of light irradiates in the black box. The amount of light passing through the fans is recorded in Table 1 as follows.

TABLE 1

| | Frame size | | |
|---|---|---|---|
| | SQ 50 mm | SQ 60 mm | SQ 70 mm |
| fan assembly of the present invention | 7.2 Lux | 4.13 Lux | 1.3 Lux |
| conventional fan assembly | 490 Lux | 329 Lux | 318 Lux |

In a 50 mm-sized frame, the amount of light passing through the conventional fan assembly is 490 Lux, but the amount of light passing through the fan assembly of embodiments of the invention designed with light-blocking characteristics is only 7.2 Lux. Thus it demonstrates that the present invention can block light effectively.

While the invention has been described by way of example and in terms of preferred embodiment, it is to be understood that the invention is not limited thereto. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A fan assembly, applicable to a light source producing heat, the fan assembly comprising:

a frame having an opening and a periphery of the opening having a curved surface; and an impeller disposed in the frame and having blade edges parallel to the curved surface and keeping a consistent distance;

wherein, when light emitted by the light source enters the opening, the light is blocked from penetrating the opening by the curved surface and the blade edges.

2. The fan assembly as claimed in claim 1, wherein the opening forms an inlet and an outlet of the frame, and the emitted light entering the inlet is blocked from emitting out of the outlet by the curved surface and the blade edges.

3. The fan assembly as claimed in claim 2, wherein the periphery of the opening has an inclined angle at the inlet or the outlet, or a vicinity of the periphery comprises a guided inclined angle.

4. The fan assembly as claimed in claim 1, wherein the curved surface has a concave surface, depressed toward a central axis of the opening, and the blade edges of the impeller exceed a line connected by two ends of the curved surface.

5. The fan assembly as claimed in claim 1, wherein the curved surface has a convex surface protruded toward a central axis of the opening, each of the blade edges of the impeller has a concave side facing the curved surface of the opening, and the curved surface of the periphery of the opening exceeds a line connected by two ends of the concave side of each of the blade edges of the impeller.

6. The fan assembly as claimed in claim 5, wherein the periphery of the opening has an inclined angle or a vicinity of the periphery comprises a guided inclined angle.

7. The fan assembly as claimed in claim 1, wherein the curved surface has a contracting curved surface and an expanding curved surface.

8. The fan assembly as claimed in claim 1, further comprising a motor base disposed in the frame, and a plurality of ribs for supporting the motor base; wherein the motor base has a slope inclined radially, thereby increasing areas of air flow intake or outtake.

9. The fan assembly as claimed in claim 8, wherein the slope is flat or curved.

10. The fan assembly as claimed in claim 1, wherein a maximum outer diameter of the blade edges is greater than a minimum inner diameter of the periphery of the opening.

11. The fan assembly as claimed in claim 1, wherein the blade edges of the impeller have a flat, conical, or stepped shape.

12. The fan assembly as claimed in claim 11, wherein the impeller has blades, each of which overlaps an adjacent blade in an axial direction of the opening.

13. A fan assembly, applied to a light source producing heat, the fan assembly comprising:

a frame having an opening, and a periphery of the opening having multi-sectional inclined surfaces with different inclined angles; and an impeller disposed in the frame and having varied blade edges;

wherein, when light emitted by the light source enters the opening, the light is blocked from penetrating the opening by the multi-sectional inclined surfaces and the varied blade edges.

14. The fan assembly as claimed in claim 13, wherein the blade edges are parallel to one inclined surface of the multi-sectional inclined surface.

15. The fan assembly as claimed in claim 13, wherein the multi-sectional inclined surfaces of the periphery of the opening are depressed toward a central axis of the opening, and each of the blade edges exceed a line connected by two ends of the multi-sectional inclined surfaces of the frame.

16. The fan assembly as claimed in claim 13, wherein the multi-sectional inclined surfaces of the periphery of the opening have a convex side protruded toward a central axis of the opening, the blade edges have a concave surface facing the convex side of the multi-sectional inclined surfaces, and the periphery of the opening exceeds a line connected by two ends of the concave surface of the blade edges of the impeller.

17. The fan assembly as claimed in claim 13, wherein the periphery of the opening has an expanding inclined surface.

18. The fan assembly as claimed in claim 13, further comprising a motor base disposed in the frame, and a plurality of ribs for supporting the motor base; wherein the motor base has a flat or curved slope inclined radially, thereby increasing areas of air flow intake or outtake.

19. The fan assembly as claimed in claim 13, wherein a maximum outer diameter of each of the blade edges is greater than a minimum inner diameter of the periphery of the opening.

20. The fan assembly as claimed in claim 13, wherein the blade edges of the impeller have a flat, conical, or stepped shape.

21. The fan assembly as claimed in claim 13, wherein each of the blades overlaps an adjacent blade in an axial direction of the opening.

* * * * *